US007719473B2

(12) United States Patent
Asano et al.

(10) Patent No.: US 7,719,473 B2
(45) Date of Patent: May 18, 2010

(54) MOBILE ANTENNA UNIT AND ACCOMPANYING COMMUNICATION APPARATUS

(75) Inventors: Takeshi Asano, Abugi (JP); Shohhei Fujio, Machida (JP)

(73) Assignee: Lenovo (Singapore) Pte Ltd., Singapore (SG)

( * ) Notice: Subject to any disclaimer, the term of this patent is extended or adjusted under 35 U.S.C. 154(b) by 0 days.

(21) Appl. No.: 12/127,091

(22) Filed: May 27, 2008

(65) Prior Publication Data

US 2008/0224933 A1 Sep. 18, 2008

Related U.S. Application Data

(62) Division of application No. 10/788,056, filed on Feb. 26, 2004, now Pat. No. 7,379,025.

(30) Foreign Application Priority Data

Feb. 27, 2003 (JP) ..... 2003-050328

(51) Int. Cl.
*H01Q 1/24* (2006.01)

(52) U.S. Cl. ..... 343/702; 343/700 MS

(58) Field of Classification Search ..... 343/702, 343/700 MS, 846, 829
See application file for complete search history.

(56) References Cited

U.S. PATENT DOCUMENTS 4,370,657 A * 1/1983 Kaloi ..... 343/700 MS
4,401,988 A * 8/1983 Kaloi ..... 343/700 MS
4,835,538 A * 5/1989 McKenna et al. ..... 343/700 MS
5,008,681 A * 4/1991 Cavallaro et al. ..... 343/700 MS
5,382,959 A * 1/1995 Pett et al. ..... 343/700 MS
5,627,550 A * 5/1997 Sanad ..... 343/700 MS
5,898,404 A * 4/1999 Jou ..... 343/700 MS
6,008,764 A * 12/1999 Ollikainen et al. .... 343/700 MS
6,326,921 B1 * 12/2001 Egorov et al. ..... 343/700 MS
6,509,882 B2 * 1/2003 McKivergan ..... 343/818
6,614,400 B2 * 9/2003 Egorov ..... 343/702
6,958,730 B2 * 10/2005 Nagumo et al. ..... 343/702

(Continued)

FOREIGN PATENT DOCUMENTS

JP 03005087 1/1991

(Continued)

OTHER PUBLICATIONS

Office Action of Oct. 17, 2005 pertaining to U.S. Appl. No. 10/788,056.

(Continued)

*Primary Examiner*—Tho G Phan
(74) *Attorney, Agent, or Firm*—Law Office of Frank V. DeRosa, P.C.

(57) ABSTRACT

An antenna unit is provided with an inverted F-type antenna element provided with a feeding point and a ground connection point, and a non-feed antenna element configured so as to resonate with the inverted F-type antenna element through electrical coupling. In addition, the antenna unit may also be provided with a ground part which is grounded to the earth and connected to the ground connection point provided on one edge of the inverted F-type antenna element, and a resonance element, one edge of which is connected to the ground part, resonated by the non-feed antenna element through electrical coupling.

12 Claims, 4 Drawing Sheets

U.S. PATENT DOCUMENTS

| | | | | |
|---|---|---|---|---|
| 2004/0080457 | A1* | 4/2004 | Guo et al. | 343/700 MS |
| 2004/0113848 | A1* | 6/2004 | Gaucher et al. | 343/702 |
| 2004/0198293 | A1* | 10/2004 | Sadler et al. | 455/280 |

FOREIGN PATENT DOCUMENTS

| | | |
|---|---|---|
| JP | 06066577 | 8/1994 |
| JP | 06069718 | 11/1994 |
| JP | 11041026 | 12/1999 |
| JP | 3026171 | 1/2000 |
| JP | 2001160710 | 6/2001 |
| JP | 2001168634 | 6/2001 |
| JP | 2002158522 | 5/2002 |
| JP | 3326762 | 7/2002 |
| JP | 2002271118 | 9/2002 |
| JP | 2002135040 | 10/2002 |
| JP | 2002330025 | 11/2002 |
| JP | 2003008325 | 1/2003 |
| JP | 2003051705 | 2/2003 |

OTHER PUBLICATIONS

Office Action of Sep. 19, 2007 pertaining to U.S. Appl.No. 10/788,056.

* cited by examiner

MOBILE ANTENNA UNIT AND ACCOMPANYING COMMUNICATION APPARATUS

CROSS-REFERENCE TO RELATED APPLICATIONS

This application is a Divisional of U.S. patent application Ser. No. 10/788,056, filed on 26 Feb. 2004, which is now U.S. Pat. No. 7,379,025, which application is incorporated herein by reference, which claims priority to Japanese patent application No. 2003-050328 filed 27 Feb. 2003.

BACKGROUND OF THE INVENTION

1. Field of the Invention

The present invention relates to an antenna unit and an accompanying communication apparatus. More specifically, the present invention relates to an improved antenna unit and communication apparatus for optimized use in more than one frequency band.

2. Background

Mobile communication devices that perform radio communications, such as a notebook type personal computers, Personal Digital Assistants (PDAs), etc., need to be as small as possible to maximize consumer acceptance. In addition, such devices must increasingly be capable of efficient communication across a plurality of frequency bands often being used for wireless LANs. Conventionally, for such purposes, a print dipole antenna has been proposed which is shareable between two frequency bands. For more information on such antennas, the reader may refer to the following papers:

Yosio Ehine "Print Dipole Antenna Sharable between Two Frequencies: Non-feed Element Side Arrangement" Proceedings of the 1989 IEICE Spring General Conference B-72, p. 2-72; and Masatoshi Karigome "Energizing of Non-feed Element in Print Dipole Antenna Sharable between Two Frequencies" proceedings of the 1989 IEICE Spring General Conference B-73, p. 2-73.

In addition, to minimize the size of the antenna, a method has been disclosed in which an antenna corresponding to a first frequency band and an antenna corresponding to a second frequency band are provided on both sides of a substrate. Such an antenna is described in more detail in Published Unexamined Patent Application No. 2003-8325.

However, such two-frequency print dipole antennas use half wave resonance, so that the size of the antenna must be larger than an antenna utilizing ¼ wave resonance and they also make it difficult to realize acceptable communications performance across a wide frequency band, such as the 5 GHz frequency band specified in wireless LAN standards such as IEEE 802.11a.

It is therefore an object of this invention to provide an antenna unit and a communication apparatus that can solve the above-mentioned problems. This purpose is achieved by combinations of characteristics described in the independent claims appended hereto. In addition, dependent claims appended hereto specify further advantageous embodiments of this invention.

SUMMARY OF THE INVENTION

According to a first embodiment of this invention, an antenna unit is provided which includes an inverted F-type antenna element provided with a feeding point and a ground connection point and a non-feed antenna element configured to resonate with the inverted F-type antenna element through electrical coupling.

According to a second embodiment of this invention, an antenna unit is provided which includes a ground part grounded to the earth, a feed antenna element, one edge of which is connected to the ground part and which is provided with a feeding point between the one edge and the other, a non-feed antenna element which is resonated by the feed antenna element through electrical coupling, and a resonance element, one edge of which is connected to the ground part and which is resonated by the non-feed antenna element through electrical coupling.

According to a third embodiment of this invention, a communication apparatus is provided which includes a transmission circuit that generates signals to be radio-transmitted, an inverted F-type antenna element having a feeding point that is supplied with signals generated by the transmission circuit and a ground connection point, and a non-feed antenna element configured to resonate with the inverted F-type antenna element by electrical coupling.

According to a fourth embodiment of this invention, a communication apparatus is provided which includes a transmission circuit that generates signals to be radio-transmitted, a ground part grounded to the earth, a feed antenna element, one edge of which is connected to the ground part and which is provided with a feeding point between the one edge and the other that is supplied with signals generated by the transmission circuit, a non-feed antenna element resonated by the feed antenna element through electrical coupling, and a resonance element, one edge of which is connected to the ground part and which is resonated by the non-feed antenna element through electrical coupling.

In the above-described summary of this invention, as readily recognized by one skilled in the relevant arts, all characteristics listed are not necessarily needed for the invention and subcombinations of these characteristics may serve as the invention.

BRIEF DESCRIPTION OF THE DRAWINGS

Embodiments of the present invention will be described in some detail in the following specification and with reference to the following figures in which like elements are referred to using like reference numbers and in which:

FIG. 3(*b*) shows an example of a VSWR analysis result for an antenna unit according to an embodiment of the present invention when operating in the 5 GHZ frequency band;

FIG. 4(*b*) shows measured values of gain of an antenna unit according to an embodiment of the present invention when operating in the 5 GHz frequency band.

DETAILED DESCRIPTION OF EMBODIMENTS OF THE PRESENT INVENTION

Figure 1:
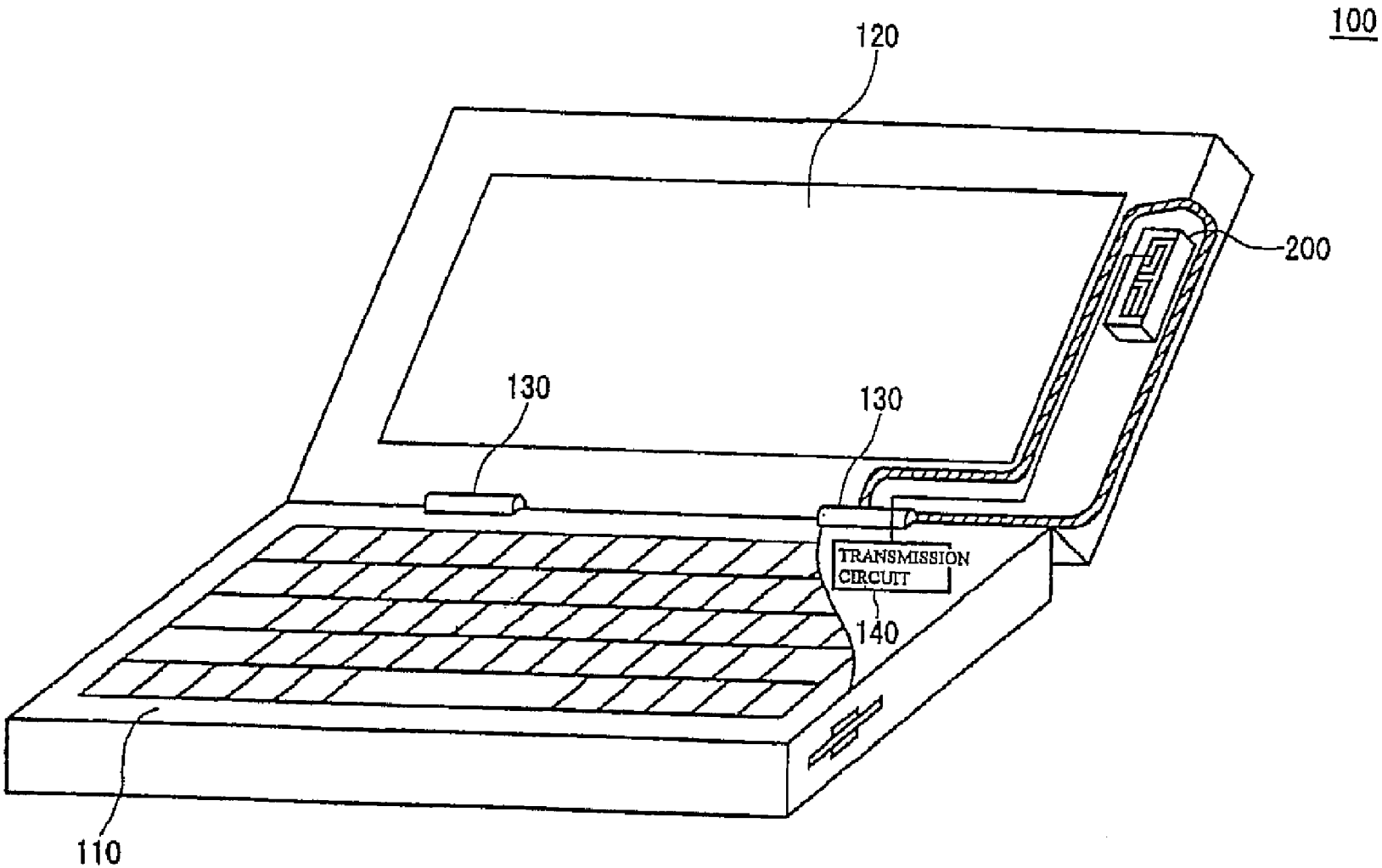
FIG. 1 is a perspective view of a communication apparatus according to an embodiment of this invention.

Hereinafter, the present invention will be explained by way of description of exemplary embodiments, however, these embodiments should not be read as limiting the invention's scope which shall be delineated solely by the claims appended hereto. In addition, all combinations of characteristics explained in these embodiments are not necessary for each implementation of the invention FIG. 1 shows a structure of an information processing apparatus 100 according to this embodiment. The information processing apparatus 100 is an example of communication devices in accordance with an embodiment of the present invention, and communicates via radio with other wireless-enabled devices. The information processing apparatus 100 has an input part 110 to input user operations of the information processing apparatus 100, a display part 120 to output information to users of the information processing apparatus 100, and a hinge part 130 which connects the display part 120 so as to be opened or closed from against the input part 110. In addition, the information processing apparatus 100 also has a transmission circuit 140, which generates signals to be radio-transmitted, and an antenna unit 200, which is supplied with signals generated by the transmission circuit 140 and radiates (and receives) radio waves.

The information processing apparatus 100 according to this embodiment is capable of communicating on at least a first frequency band (high frequency band), such as the 5 GHz frequency band used for IEEE802.11a, and a second frequency band (low frequency band), such as the 2.45 GHz frequency band used for IEEE802.11b/g or Bluetooth(registered trademark), which is lower than the first frequency band. By providing the antenna unit 200, the effective band over which it may communicate is extended in the first frequency band, efficient radio communication performance is realized.

Figure 2:
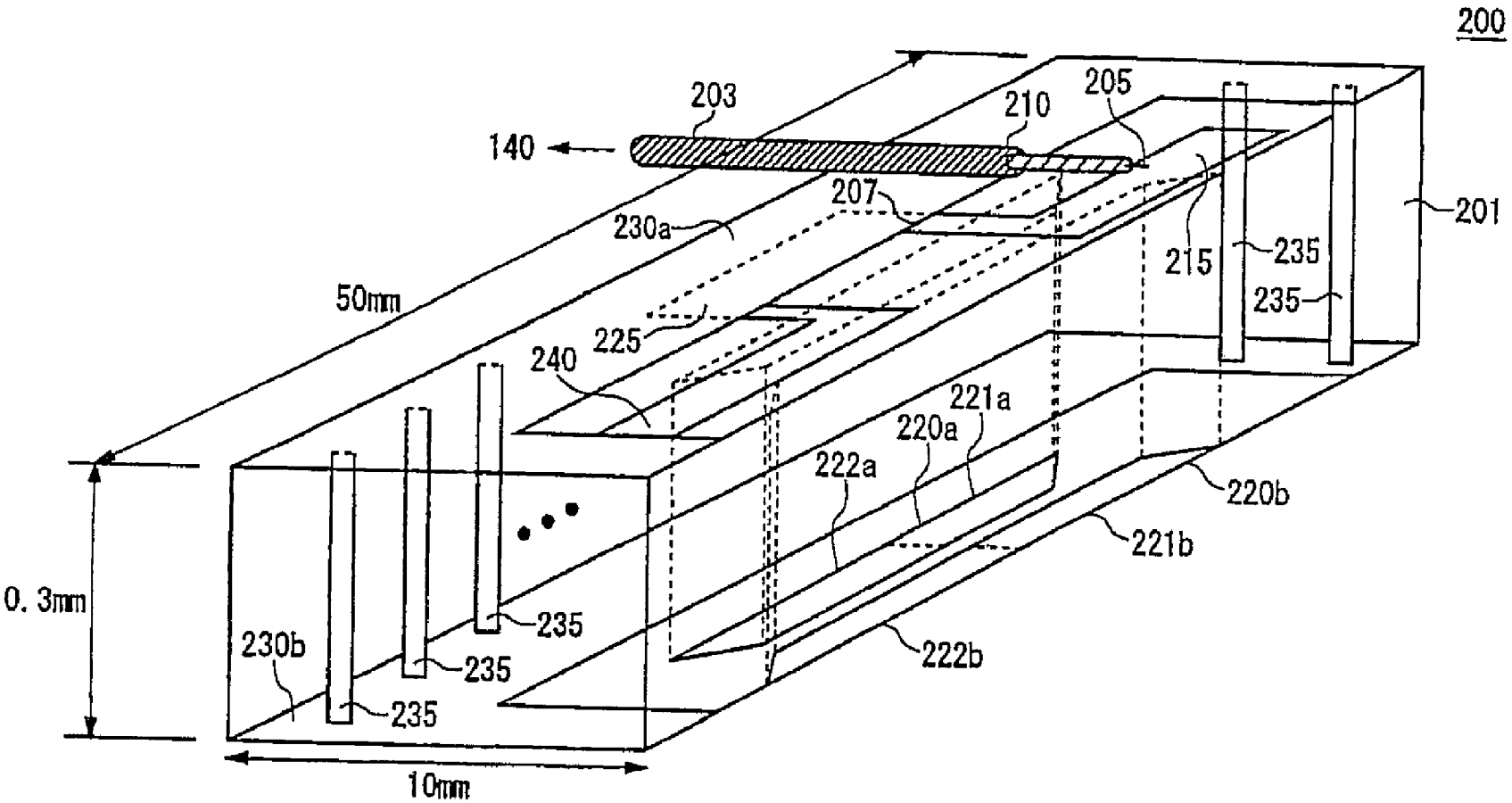
FIG. 2 is a perspective, transparent view of the structure of an antenna unit according to an embodiment of this invention.

FIG. 2 shows a structure of the antenna unit 200 according to this embodiment. The antenna unit 200 has an insulating substrate 201, a feeding line 203, an inverted F-type antenna element 215, non-feed antenna elements 220*a* and 220*b*, shield parts 230*a* and 230*b*, a ground connection part 235 and a resonance element 240.

The insulating substrate 201 is provided on the side of the display part 120 so that its top and bottom surfaces are parallel with the top surface of the display part 120, and is incorporated with other elements and components of the antenna unit 200. An exemplary insulating substrate 201 according to this embodiment is about 50 mm along its long side, about 10 mm along its short side, and about 0.3 mm in thickness.

The feeding line 203, which comprises a type of wiring, such as a coaxial cable, supplies transmission signals generated by the transmission circuit 140 to the antenna unit 200.

The inverted F-type antenna element 215 is provided on the top surface of the insulating substrate 201 in parallel with the top surface of the display part 120, e.g., by printed wiring, and connected to the core-wire of the feeding line 203. The inverted F-type antenna element 215 is an example of inverted F-type antenna elements and feed antenna elements according to this invention. The inverted F-type antenna element 215 is provided between a ground connection point 207 connected to a ground part 225 on the shield part 230*a* at one edge, an edge having the ground connection point 207 and the other, and has a feeding point 205 fed with transmission signals generated by the transmission circuit 140. The inverted F-type antenna element 215 according to this embodiment has a L-shaped structure, in which the element is extended by a first length from the ground connection point 207 in the direction of the short side of the insulating substrate 201 and then the element is extended by a second length longer than the first length in the direction of the long side of the insulating substrate 201.

The plurality of non-feed antenna elements 220 (the non-feed antenna elements 220*a* and 220*b*) are provided on the bottom surface of the insulating substrate 201 in parallel with the top surface of display part 120, e.g., by printed wiring, and are non-feed elements provided so as to resonate with the inverted F-type antenna element 215 through electrical coupling. Each of the non-feed antenna elements 220*a* and 220*b* has overlapped parts with the inverted F-type antenna element 215 and the resonance element 240 in the perpendicular direction of the insulating substrate 201.

The shield parts 230*a* and 230*b* are grounded to the earth and surround the back that is in a radiation direction of an electromagnetic wave transmitted by the antenna unit 200 and the sides of the inverted F-type antenna element 215 and the non-feed antenna elements 220*a* and 220*b*. Each of the shield parts 230*a* and 230*b* may be U-shaped, the outside edge of which is three sides of top and bottom surfaces of the insulating substrate 201. The shield parts 230*a* and 230*b* are provided in the side of the display part 120 rather than the inverted F-type antenna element 215 and the non-feed antenna elements 220*a* and 220*b*, and prevents features of the antenna unit 200 from being influenced by signal lines or ground parts of the display part 120 and other devices.

In this embodiment, the shield part 230*a* is connected to the shield line of the feeding line 203 at a shield connection point 210, and functions as a ground part for the inverted F-type antenna element 215. In addition, one part of the shield part 230*a* is grounded to the earth via a shield line, and functions as the ground part 225 which is connected to one edge of each of the inverted F-type antenna element 215 and the resonance element 240. Alternatively, at least one of the shield parts 230*a* and 230*b* may also be electrically connected to ground potential provided in the information processing apparatus 100 at a point other than the shield connection point 210.

The ground connection part 235 is a conductor, which is provided at a via hole that penetrates the insulating substrate 201, and electrically connects the shield parts 230*a* and 230*b*. The resonance element 240, one edge of which is connected to the ground part 225 on the shield part 230*a*, is resonated by the non-feed antenna elements 220*a* and 220*b* through electrical coupling. In this embodiment, the resonance element 240 is extended from the edge connected to the ground part 225 toward a direction away from the inverted F-type antenna element 215. In addition, after extending a first length, like the inverted F-type antenna element 215, from the edge connected to the shield part 230*a* in the direction of the short side of the insulating substrate 201, the resonance element 240 is extended by a second length longer than the first length in a direction of the long side of the insulating substrate 201 toward the direction away from the inverted F-type antenna element 215. Therefore, the inverted F-type antenna element 215 and the insulating substrate 201 are provided so that the parts extending in the direction of the long side of the insulating substrate 201 are positioned approximately along a straight line with each other. In addition, in the resonance element 240 according to this embodiment, the other edge, which is different from the edge connected to the ground part 225, is connected to the shield part 230*a* electrically connected with the ground part 225, but alternatively, the edge may also be a free edge that is not connected to the shield part 230*a*.

Next, a structure and operation of the antenna unit 200 will be explained corresponding to each of the first and second frequency bands.

(1) The First Frequency Band

When a first frequency signal in the first frequency band is supplied to the feeding point 205, the inverted F-type antenna element 215 oscillates. Subsequently, the non-feed antenna elements 220*a* and 220*b* resonate with the inverted F-type antenna element 215, and radiate an electromagnetic wave corresponding to the first frequency signal as a waveguide device to radiate an electromagnetic wave.

The inverted F-type antenna element 215 may have a length of about one-fourth of the wavelength in the first frequency band so as to oscillate by receiving a transmission signal supplied from the transmission circuit 140.

In addition, to make the non-feed antenna elements 220*a* and 220*b* resonate with the inverted F-type antenna element 215 through electrical coupling, each of the inverted F-type antenna element 215 and the non-feed antenna elements 220*a* and 220*b* may have an electrically coupled plane in parallel facing each other in the side of the insulating substrate 201. The distance between the inverted F-type antenna element 215 and the non-feed antenna elements 220*a* and 220*b* may be within a length over which electrical coupling effectively operates, e.g., one-tenth or less of a wavelength corresponding to a resonance frequency at which the inverted F-type antenna element 215 resonates in the first frequency band.

In addition, each of the non-feed antenna elements 220*a* and 220*b* according to this embodiment has two or more different lengths along a direction of resonance with the inverted F-type antenna element 215, that is, in the direction of the long side of the insulating substrate 201. This enables each of the non-feed antenna elements 220*a* and 220*b* to resonate with the inverted F-type antenna element 215 in a wide band of the first frequency band, and features of the antenna unit 200 can be maintained well in the wide band of the first frequency band.

More specifically, in each of the non-feed antenna elements 220*a* and 220*b* according to this embodiment, the surface that faces the inverted F-type antenna element 215, that is, touches the insulating substrate 201, is trapezoid-shaped, the base direction of which is a direction of resonance with the inverted F-type antenna element 215. With this structure, each of the non-feed antenna elements 220*a* and 220*b* allows features of the antenna unit 200 to be stabilized well in a wide band of the first frequency band.

In addition, in accordance with this embodiment, the non-feed antenna elements 220*a* and 220*b* have different lengths along a direction of resonance with the inverted F-type antenna element 215, that is, in the direction of the long side of the insulating substrate 201. More specifically, the non-feed antenna element 220*b*, which is placed farther from the display part 120 and touches a side of the insulating substrate 201, is longer than the non-feed antenna element 220*a* along a direction of resonance with the inverted F-type antenna element 215. With this structure, the non-feed antenna elements 220*a* and 220*b* resonate efficiently with the inverted F-type antenna element 215 across different frequency ranges. At a result, by providing the non-feed antenna elements 220*a* and 220*b*, at least either the non-feed antenna element 220*a* or the non-feed antenna element 220*b* efficiently resonates with the inverted F-type antenna element 215 corresponding to any frequency supplied to the feeding point 205 in the first frequency band, so that features of the antenna unit 200 can be maintained well across a wide band of the first frequency band.

Each of the non-feed antenna elements 220*a* and 220*b* according to this embodiment is placed so that a side of it shorter than the other sides faces the other non-feed antenna element along a direction of resonance with the inverted F-type antenna element 215. More specifically, the non-feed antenna elements 220*a* and 220*b* are trapezoid-shaped, in which they have their top sides and bases along a direction of resonance with the inverted F-type antenna element 215 and the top sides, which are shorter than the bases, face each other. With this structure, electrical interference between the non-feed antenna elements 220*a* and 220*b* is minimized.

(2) The Second Frequency Band

When a signal in the second frequency band lower than the first frequency band is supplied to the feeding point 205, the inverted F-type antenna element 215, the non-feed antenna elements 220*a* and 220*b*, and the resonance element 240 oscillate in the shape of a loop, so that the antenna unit 200 radiates electromagnetic waves corresponding to the second frequency signal.

In this embodiment, the non-feed antenna elements 220*a* and 220*b* have feed antenna side electrostatic connection parts 221*a* and 221*b*, which face the inverted F-type antenna element 215 and resonate through electrical coupling, and resonance element side electrostatic connection parts 222*a* and 222*b*, which face the resonance element 240 and allow the inverted F-type antenna element 215 to be resonated by electrical coupling, respectively.

When a second frequency signal is supplied to the feeding point 205, by electrical coupling, a current, which is reverse to the current flowing through the inverted F-type antenna element 215, occurs at the feed antenna side electrostatic connection parts 221*a* and 221*b*. Subsequently, by the current occurring at the feed antenna side electrostatic connection parts 221*a* and 221*b*, a current occurs at the resonance element side electrostatic connection parts 222*a* and 222*b*. As a result, by electrical coupling, a current, which is reverse to the current flowing through the resonance element side electrostatic connection parts 222*a* and 222*b*, occurs at the resonance element 240, so that the inverted F-type antenna element 215, the non-feed antenna elements 220*a* and 220*b*, and the resonance element 240 oscillate in the shape of a loop. In this embodiment, the loop-shaped route has a length approximately equal to that of a standing wave of one period generated by the loop oscillation resulting from the second frequency signal. For example, in the case of the 2.45 Ghz frequency band (about 12 cm in wavelength), the loop-shaped route is designed so as to be 7 to 8 cm considering the guidance and capacity components of the antenna unit 200.

As described above, the antenna unit 200 according to this embodiment functions as an inverted F-type antenna, which has the non-feed antenna elements 220*a* and 220*b* that become a waveguide device in the first frequency band, and functions as a loop-type antenna in the second frequency band lower than the first frequency band. In the first frequency band, as the result of the use of ¼ wave resonance, this allows the antenna unit 200 to amplify radiation energy, which is half of that of dipole type, through the non-feed antenna elements 220*a* and 220*b*. On the other hand, in the second frequency band that has a longer wavelength, by oscillating at a loop-shaped route, the long side of the antenna unit 200 can be made shorter so that the overall size of the antenna unit may be minimized.

In addition, the antenna unit 200 is adopted with a feeding structure of inverted F-type element, so that input impedance can easily be adjusted by changing the position of the feeding point 205. Therefore, compared with a print dipole antenna designed to operate in two frequency bands, which adjusts input impedance according to the thickness of a substrate, the thickness of the substrate according to embodiments of the present invention can be minimized, again, allowing the overall size of the antenna unit 200 to be minimized.

Figure 3A:
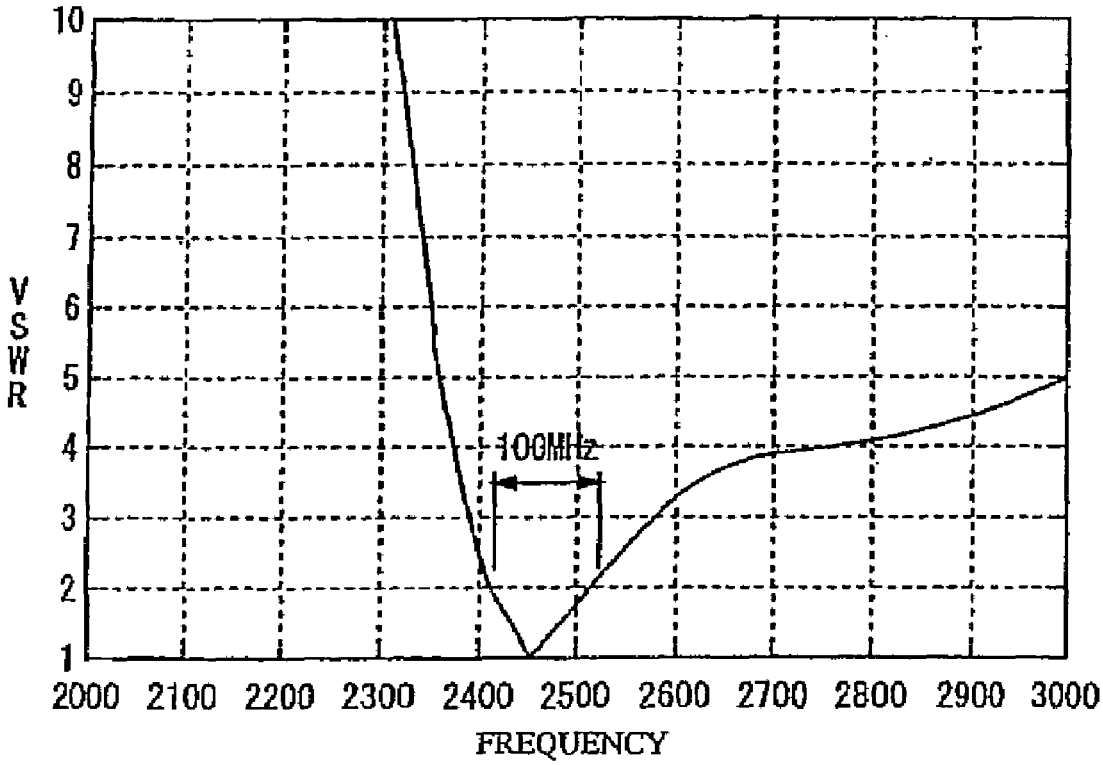
FIG. 3(*a*) shows an example of a voltage standing wave ratio (VSWR) analysis result for an antenna unit according to an embodiment of the present invention when operating in the 2 GHz frequency band.
Figure 3B:
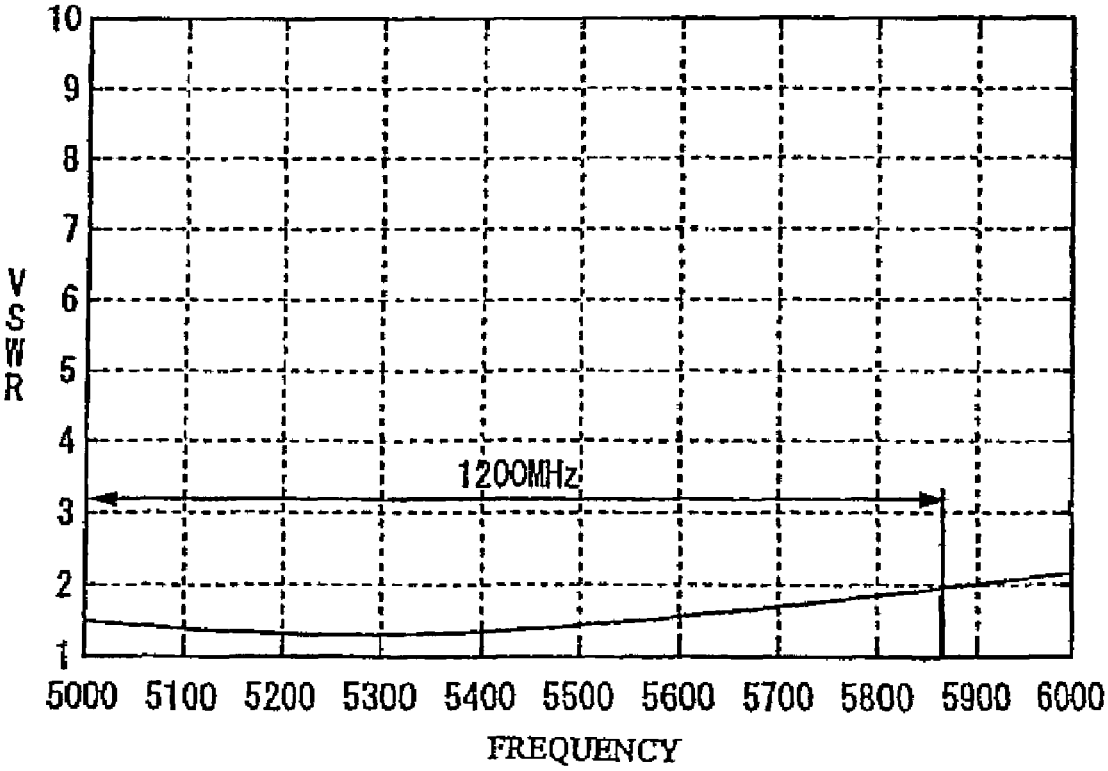

FIG. 3(*a*) shows a numerical analysis result of the VSWR (Voltage Standing Wave Ratio) characteristics of the antenna unit 200 in the 2.45 GHz frequency band. In the 2.45 GHz frequency band, it is required that communications be performed well across 100 MHz of bandwidth. As shown in FIG. 3(*a*), the antenna unit 200 according to this embodiment can suppress VSWR to two or less across 100 MHz of bandwidth in the 2.45 GHz frequency band, and communications that are appropriate for IEEE 802.11b/g and Bluetooth (registered trademark) may be efficiently performed.

FIG. 3(*b*) shows a numerical analysis result of the VSWR characteristics of the antenna unit 200 in the 5 GHz frequency band. In the 5 GHz frequency band, it is required that communications be performed well across 700 MHz of bandwidth from 5.15 GHz to 5.85 GHz. As shown in FIG. 3(*b*), the antenna unit 200 according to this embodiment can suppress VSWR to two or less across 1200 MHz of bandwidth in the 5 GHz frequency band, and communications that are appropriate for IEEE 802.11a can be efficiently performed.

Figure 4A:
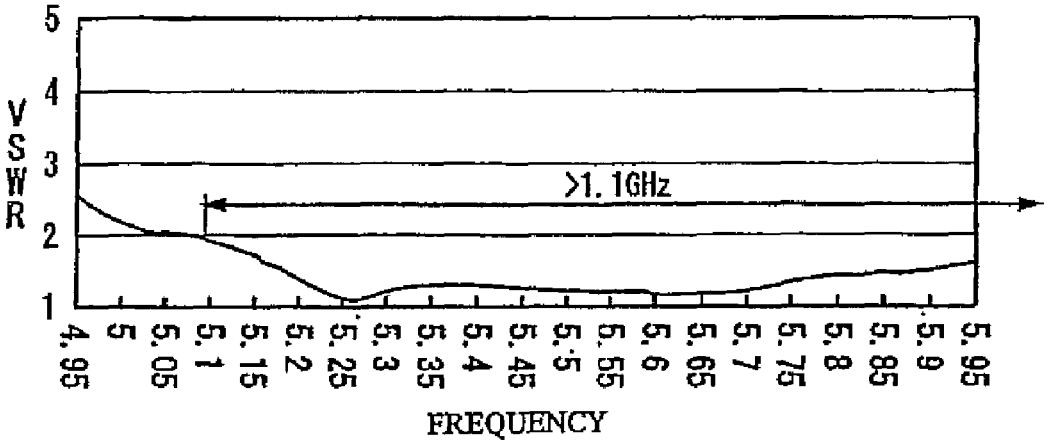
FIG. 4(*a*) shows measured values of VSWR for an antenna unit according to an embodiment of the present invention operating in the 5 GHz frequency band.
Figure 4B:
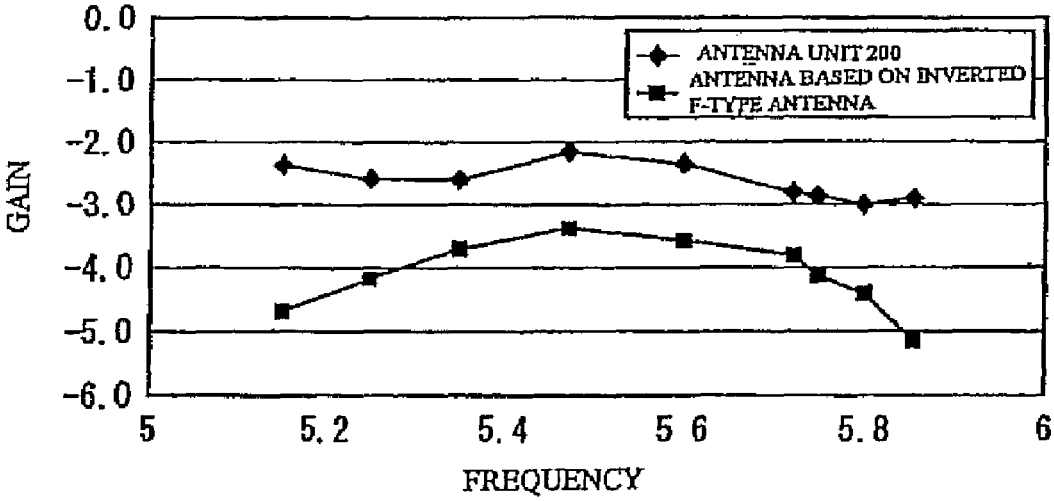

FIG. 4(*a*) shows measured values of the VSWR characteristics of the antenna unit 200 in the 5 GHz frequency band. When the VSWR characteristics of the antenna unit 200 according to this embodiment is measured, VSWR is suppressed to two or less across a bandwidth of about 1100 MHz or more from about 5.1 GHz in the 5 GHz frequency band. Achieving better VSWR characteristics across such a wide bandwidth results from providing the non-feed antenna elements 220 having two or more different lengths, the lengths being different along a direction of resonance with the inverted F-type antenna element 215 and providing a plurality of the non-feed antenna elements 220, the lengths of which are different along a direction of resonance with the inverted F-type antenna element 215.

FIG. 4(*b*) shows measurement values of gain of the antenna unit 200 in the 5 GHz frequency band. When gain characteristics of the antenna unit 200 according to this embodiment is measured, a high and stable gain was achieved compared with other antennas developed based on an inverted F-type antenna structure across 700 MHz of bandwidth in the 5 GHz frequency band. Achieving a high and stable gain across such a wide bandwidth results from providing the trapezoid-shaped non-feed antenna element 220, the base direction of which is along a direction of resonance with the inverted F-type antenna element 215 and providing a plurality of the non-feed antenna elements 220, the lengths of which are different along a direction of resonance with the inverted F-type antenna element 215.

The present invention has been explained in some detail by describing one or more exemplary embodiments. However, it is to be understood that the scope of the present invention is not restricted to the range of the above-described embodiments. Those skilled in the relevant arts will readily recognize that various changes or modifications may be made to the described embodiments without departing from the scope and spirit of the present invention, the scope of which is defined by the claims which are appended hereto.

For example, the above-described antenna unit 200 may be used for not only transmitting but also receiving. In this case, signals received by the antenna unit 200 is supplied to a receiving circuit connected with the feeding line 203 via the feeding point 205. If used for receiving, the antenna unit 200 shows good features as in the case of transmitting. This is clear from the reciprocal theorem of antennas.

What is claimed is:

1. An antenna unit, comprising:

a ground part grounded to the earth;

a feed antenna element, a first edge of which is connected to said ground part, provided with a feeding point between said first edge and a second edge of said antenna element;

a non-feed antenna element, which is resonated by said feed antenna element through electrical coupling; and a resonance element, one edge of which is connected to said ground part, which is resonated by said non-feed antenna element through electrical coupling, wherein said non-feed antenna element comprises two or more non-feed antenna elements, the lengths of which are different along a direction of resonance with said feed antenna element and said resonance element.

2. The antenna unit according to claim 1, wherein said feed antenna element, said non-feed antenna element and the resonance element oscillate in the shape of a loop, and said loop-shaped route has a length of a standing wave of one period generated by said oscillation.

3. The antenna unit according to claim 1, wherein each of said two or more non-feed antenna elements has a feed antenna element side electrical coupling part, which faces said feed antenna element and which resonates through electrical coupling, and a resonance element side electrical coupling part, which faces said resonance element and allows said resonance element to be resonated by electrical coupling.

4. The antenna unit according to claim 1, wherein said resonance element extends in a direction that maintains a distance between said feed antenna element and said edge of said resonance element that is connected to said ground part.

5. The antenna unit according to claim 1, wherein the feed antenna element comprises an inverted F-type antenna element.

6. An antenna unit, comprising:

a ground part grounded to the earth;

a feed antenna element, a first edge of which is connected to said ground part, provided with a feeding point between said first edge and a second edge of said antenna element;

a non-feed antenna element, which is resonated by said feed antenna element through electrical coupling; and a resonance element, one edge of which is connected to said ground part, which is resonated by said non-feed antenna element through electrical coupling, wherein when a first frequency signal is supplied to said feeding point, said feed antenna element oscillates and said non-feed antenna element resonates, so that said antenna unit radiates an electric wave corresponding to said first frequency signal as a waveguide device, and when a second frequency signal lower than said first frequency is supplied to said feeding point, said feed antenna element, said non-feed antenna element and the resonance element oscillate in the shape of a loop, so that said antenna unit radiates an electric wave corresponding to said second frequency signal.

7. The antenna unit according to claim 6, wherein the feed antenna element comprises an inverted F-type antenna element.

8. A communication apparatus, comprising:

a transmission circuit which generates signals to be radio-transmitted;

a ground part grounded to the earth;

a feed antenna element, a first edge of which is connected to said ground part, provided with a feeding point located between said first edge and a second edge of said feed antenna element, and which feeding point is supplied with signals generated by said transmission circuit;

a non-feed antenna element configured to resonate with said feed antenna element through electrical coupling;

a resonance element, one edge of which is connected to said ground part, configured to resonate with said non-feed antenna element through electrical coupling;

an input part for accepting user input in order to direct the operations of said communication apparatus;

a display part for outputting information to a user of said communication apparatus; and a hinge part for connecting said display part to said input part and allowing said display part to move between a closed position against said input part and an open position away from said input part, and wherein said feed antenna element and said non-feed antenna element are provided on a side of said display part and are generally parallel with said side.

9. The communication apparatus according to claim 8, wherein said non-feed antenna element comprises two or more non-feed antenna elements, the lengths of which are different along a direction of resonance with said feed antenna element and said resonance element.

10. The communication apparatus according to claim 9, wherein each of said two or more non-feed antenna elements has a feed antenna element side electrical coupling part, which faces said feed antenna element and which resonates through electrical coupling, and a resonance element side electrical coupling part, which faces said resonance element and allows said resonance element to be resonated by electrical coupling.

11. The communication apparatus according to claim 8, wherein when a first frequency signal is supplied to said feeding point, said feed antenna element oscillates and said non-feed antenna element resonates, so that said antenna unit radiates an electric wave corresponding to said first frequency signal as a waveguide device, and when a second frequency signal lower than said first frequency is supplied to said feeding point, said feed antenna element, said non-feed antenna element and the resonance element oscillate in the shape of a loop, so that said antenna unit radiates an electric wave corresponding to said second frequency signal.

12. The communication apparatus according to claim 8, wherein the feed antenna element comprises an inverted F-type antenna element.

* * * * *